United States Patent [19]

Paulson

[11] Patent Number: 4,924,951

[45] Date of Patent: May 15, 1990

[54] MANHOLE CUTTER

[76] Inventor: Roger W. Paulson, 12100 W. Marion La., Minnetonka, Minn. 55343

[21] Appl. No.: 297,099

[22] Filed: Jan. 13, 1989

[51] Int. Cl.[5] ..... E21B 3/00; E21B 12/00

[52] U.S. Cl. ..... 175/57; 175/315; 175/320; 175/402; 299/41; 294/86.25; 294/86.34

[58] Field of Search ..... 299/41, 55; 175/402, 175/403, 320, 315, 57; 404/90; 166/361; 294/86.34, 86.24, 86.25

[56] References Cited

U.S. PATENT DOCUMENTS

| | | | |
|---|---|---|---|
| 1,888,083 | 11/1932 | Holtz . | |
| 2,741,462 | 4/1956 | Baca . | |
| 2,784,955 | 3/1957 | Compton . | |
| 3,275,172 | 9/1966 | Smith . | |
| 3,297,353 | 1/1967 | Carlson . | |
| 3,306,380 | 2/1967 | Warren et al. | 175/330 |
| 3,491,844 | 1/1970 | Kelly, Jr. | 175/403 X |
| 3,550,701 | 12/1970 | Holley | 175/122 |
| 3,726,351 | 4/1973 | Williams, Jr. | 175/403 X |
| 3,771,611 | 11/1973 | Omura et al. | 175/348 |
| 3,980,190 | 9/1976 | Patterson | 214/383 |
| 4,076,087 | 2/1978 | Chuply et al. | 175/334 |
| 4,458,949 | 7/1984 | Jury | 299/41 |
| 4,516,896 | 5/1985 | Freebery | 414/740 |
| 4,545,609 | 10/1985 | Pasquazzi et al. | 294/104 |
| 4,657,441 | 4/1987 | Horvath | 175/402 X |
| 4,660,344 | 4/1987 | Guadelli et al. | 52/593 |
| 4,696,502 | 9/1987 | Desai | 294/86.34 X |

*Primary Examiner*—Hoang C. Dang
*Attorney, Agent, or Firm*—Hugh D. Jaeger

[57] ABSTRACT

Manhole cutter for cutting a circular groove of a fixed depth about a manhole, such as in a street, and removing the manhole from the street. The manhole cutter is suspended from a front-end loader or truck-mounted boom and rotated hydraulically from a power take-off unit on the vehicle. A cutter ring assembly with staggered cutters, and inside and outside clean-out slots rotate about a central shaft of the cutter. A manhole plate centers the manhole cutter within the manhole from the cutting operations. When the cut is of sufficient depth to extricate the manhole, a keyway disk is rotated to allow a plurality of lever grip assemblies to grip the manhole. Then, the manhole cutter and the manhole is extricated from the street, leaving a larger sized hole about the area of the manhole which is minimum in size with respect to the manhole. A plurality of staggered cutters align along the bottom of the cutter ring assembly to cut through asphalt and dirt, and are mounted in the cutter ring assembly by a bolt and rectangular bar.

6 Claims, 13 Drawing Sheets

MANHOLE CUTTER

BACKGROUND OF THE INVENTION

1. Field of the Invention

The present invention relates to a manhole cutter, and more particularly, pertains to a manhole cutter which allows for removal of the manhole after cutting about the manhole by a plurality of lever grip assemblies which grip against the sides of the manhole.

2. Description of the Prior Art

In the past, removal of manhole covers has been a messy, slow and cumbersome operation due to the fact that jack hammers or workers with picks and shovels excavated a large area about the manhole cover prior to its removal. Often large void areas were disturbed which required extensive repacking and filling.

The present invention overcomes the disadvantages of the prior art by providing a manhole cutter which cuts a precise hole extremely close to the manhole, thus requiring less filling and patching around the excavated site. The present invention also allows for replacing of the manhole after other adjustments, such as rings for increased height, have been installed in the manhole shaft area. The present invention eliminates the need for physical manpower to lift the castings out and back in.

SUMMARY OF THE INVENTION

The general purpose of the present invention is to provide a manhole cutter which cuts a circular groove closely about a manhole, and which also allows for subsequent removal of the manhole after the cutting operation.

According to one embodiment of the present invention, there is provided a manhole cutter which includes a central shaft, a cutter ring assembly coaxial to the shaft and supported upon the shaft by a plurality of horizontal support bars whose inner ends connect to a plate aligned with the shaft. The cutter ring assembly includes a short cylindrical cutting ring member to which a plurality of staggered cutters are attached. Also attached to the cutter ring member is a plurality of clean-out ramps on the outside surface of the cylindrical cutter ring member, and a plurality of inner clean-out ramps on the inner surface of the cylindrical cutting ring member. Also aligned to the central shaft are two plates. The first plate is a manhole plate which aligns inside the top portion of a manhole and aligns the entire manhole cutter with the manhole. The second plate is actually a keyway disk which has a number of keyways around its periphery which control a plurality of lever grip assemblies on the under side of the manhole plate, which are used to grasp the manhole and remove it vertically from the job site.

One significant aspect and feature of the present invention is a manhole cutter which cuts closely about the circumference of a manhole.

Another significant aspect and feature of the present invention is a manhole cutter which aligns with the manhole top.

An additional significant aspect and feature of the present invention is the use of lever grip assemblies to remove the manhole casting from the job site. The manhole cutter uses a keyway disk to control the position of the plurality of lever grip assemblies.

A further significant aspect and feature of the present invention is a manhole cutter which can cut a hole about a manhole and remove the manhole in one operation, as well as replacing the manhole subsequent to the removal process.

Another significant aspect and feature of the present invention is a method of securing cutting carbide teeth into a cutter ring assembly.

Having thus described the embodiments of the present invention, it is a principal object hereof to provide a manhole cutter for cutting about a manhole, removing the manhole and replacing the manhole.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
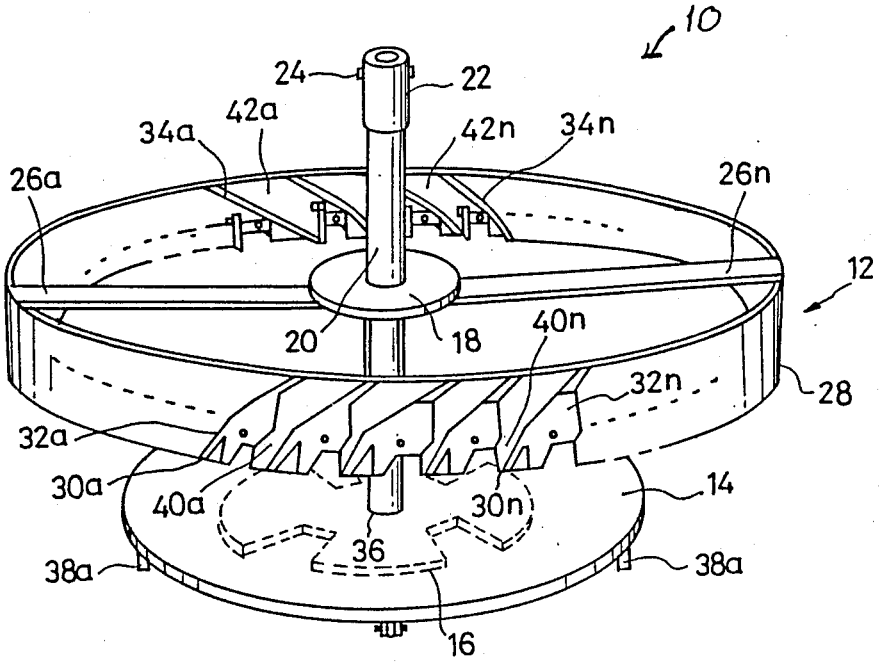
FIG. 1 illustrates a perspective view of the manhole cutter.

FIG. 1 illustrates a perspective view of the manhole cutter 10. A cutter ring assembly 12, a manhole plate 14, a keyway disk 16, and a plate 18 align with the central drive shaft 20. The cutter ring is of a diameter slightly larger than the manhole casting. The plate 18 and the keyway disk 16 secure to the central drive shaft 20 by welding or by other means. A coupler 22 and a through bolt 24 secure to the top end of the central drive shaft 20 for connection to a hydraulic power take off unit, such as that on a front-end loader, truck or other type of vehicle. A plurality of support bars **26*a*–26*n* weld to and extend from plate 18 outwardly to support the cutter ring assembly 12. The cutter ring assembly 12 includes a short cylindrical member 28 in the form of a ring, a plurality of staggered cutters 30*a*–30*n* secured to the lower annular edge of the short cylindrical member 28, a plurality of clean-out ramps 32*a*–32*n* secured about the outer circumference of the cylindrical member 28, and a plurality of inner clean-out ramps 34*a*–34*n* secured about the inner circumference of the short cylindrical member 28. The central drive shaft 20 extends through a hole 36 in the manhole plate 14, and turns freely within the hole 36. A plurality of lever grip assemblies 38a–38n mount on the lower surface of the manhole plate 14. A plurality of outer clean-out slots 40a–40n are formed between the outer clean-out ramps 32a–32n. A plurality of inner clean-out slots 42a–42n are formed between the inner clean-out ramp members 34a–34n on the interior surface of the short cylindrical member 28**.

Figure 2:
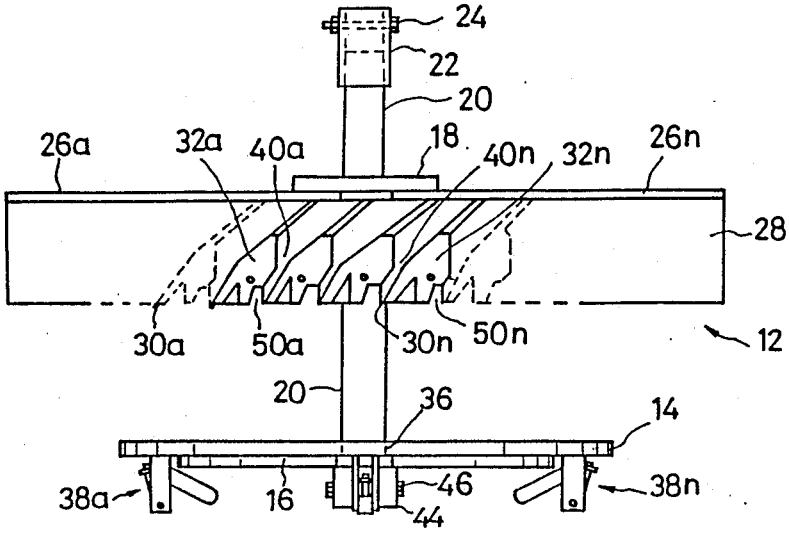
FIG. 2 illustrates a side view of the manhole cutter.

FIG. 2 illustrates a side view of the manhole cutter 10 where all numerals correspond to those elements previously described. Particularly illustrated is central drive shaft 20 extending through hole 36 in the manhole plate 14, and into a cylindrical collar 44 which is welded to the keyway disk 16. A securing bolt 46 extends through the collar 44 and through the lower portion of the central drive shaft 20.

Figure 3:
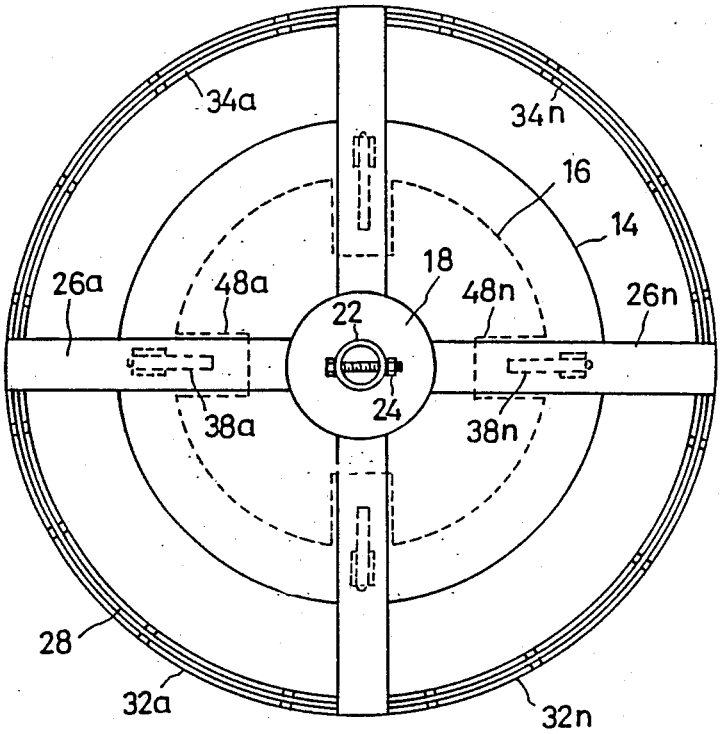
FIG. 3 illustrates a top view of the manhole cutter.

FIG. 3 illustrates a top view of the manhole cutter 10 where all numerals correspond to those elements previously described. Particularly shown in this illustration is the vertical alignment of the lever grip assemblies 38a–38n with a plurality of keyways 48a–48n in the keyway disk 16. This particular alignment is used when the manhole cutter 10 is lowered to align with the top of the manhole itself. After cutting about the manhole, the keyway disk 16 is rotated approximately 45 degrees from the depicted position in FIG. 3 to engage the lever grip assemblies 38a–38n, allowing for gripping of the manhole by the lever grip assemblies 38a–38n for removal of the manhole from the earth, as later described in detail.

Figure 4:
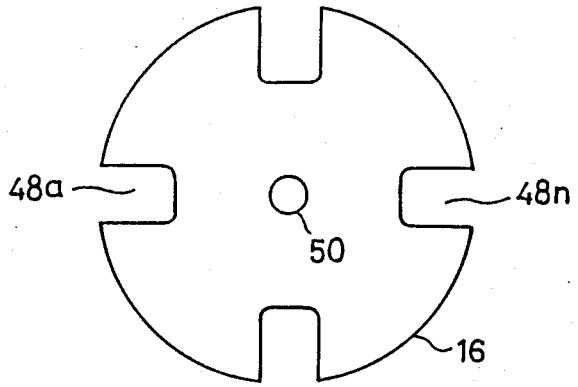
FIG. 4 illustrates a top view of the keyway disk for the manhole cutter.

FIG. 4 illustrates a top view of the keyway disk 16 where all numerals correspond to those elements previously described. Also illustrated in the center of the keyway disk 16 is a hole 50 through which the central drive shaft 20 passes. Also illustrated are the keyways 48a–48n placed at 90 degree intervals to each other.

Figure 5:
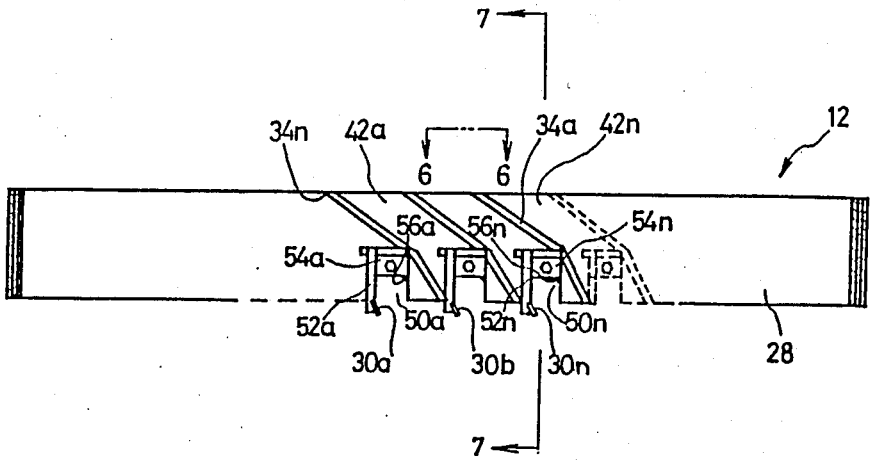
FIG. 5 illustrates the cutter carbide teeth secured to the cutter ring as viewed from the inside of the manhole cutter.

FIG. 5 illustrates a view of the inner circumference of the cutter ring assembly 12 where all numerals correspond to those elements previously described. A plurality of rectangular holes 50a–50n position along the bottom edge of the cylindrical member 28. Cutter bodies 52a–52n include staggered cutters 30a–30n mounted at the lower portion of the cutter bodies 52a–52n, and are secured at the left end or edge of the rectangular holes 50a–50n by a plurality of rectangular bars 54a–54n. The rectangular bars 54a–54n are secured to a plurality of outer clean-out ramps 32a–32n on the outer periphery of the short cylindrical member 28 by bolts 56a–56n. All of the staggered cutters 30a–30n are not illustrated for purposes of brevity and clarity.

Figure 6:
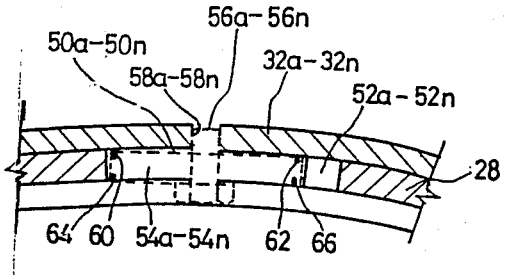
FIG. 6 illustrates a view taken along line 6—6 of FIG. 5.

FIG. 6 illustrates a view taken along line 6—6 of FIG. 5 where all numerals correspond to those elements previously described. Shown in particular is the method of securement of the cutter bodies 52a–52n in rectangular holes 50a–50n. The cutter bodies 52a–52n are placed vertically along the edge of rectangular holes 50a–50n adjacent to rectangular bars 54a–54n which also occupy the rectangular holes 50a–50n. The rectangular bars 54a–54n are rectangular solids having a central hole through which bolts 56a–56n pass. Bolts 56a–56n secure in holes 58a–58n in the outer clean-out ramps 32a–32n. As the bolts 56a–56n are tightened securely, the rectangular bars conform to the overall curved shape of the outer clean-out ramps 32a–32n. As the rectangular bars 54a–54n are forced into a bowed position, certain measurements of the rectangular bars are either decreased or increased. Points 60–66 illustrates this principal feature. Points 60 and 62 on the outer edge of the bar increase in distance between each other as pressure is applied to the bolt. Points 64 and 66, because of the bowing action, decrease in distance and come closer together. The overall stretching between points 60 and 62 actually increases the overall effective length of the rectangular bars 54a–54n, allowing the bars 54a–54n to put pressure against the cutter bodies 52a–52n, thus securing cutter bodies 52a–52n in the holes 50a–50n. The original position of the rectangular bars 54a–54n is shown in dashed lines.

Figure 7:
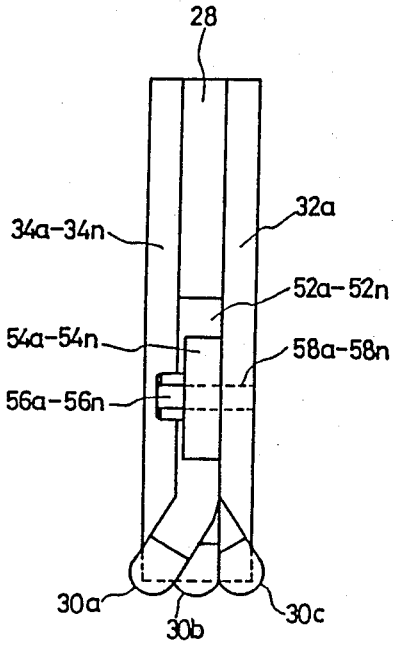
FIG. 7 illustrates a view of the staggered cutter carbide teeth taken along line 7—7 of FIG. 5.

FIG. 7 illustrates a view taken along line 7—7 of FIG. 5 illustrating the staggering of the staggered cutting carbide teeth 30a–30n. All other numerals correspond to those elements previously described. In this illustration, the inner staggered cutting tooth is 30a, the mid-staggered cutting tooth is 30b, and the outer staggered cutting tooth is 30c.

Figure 8:
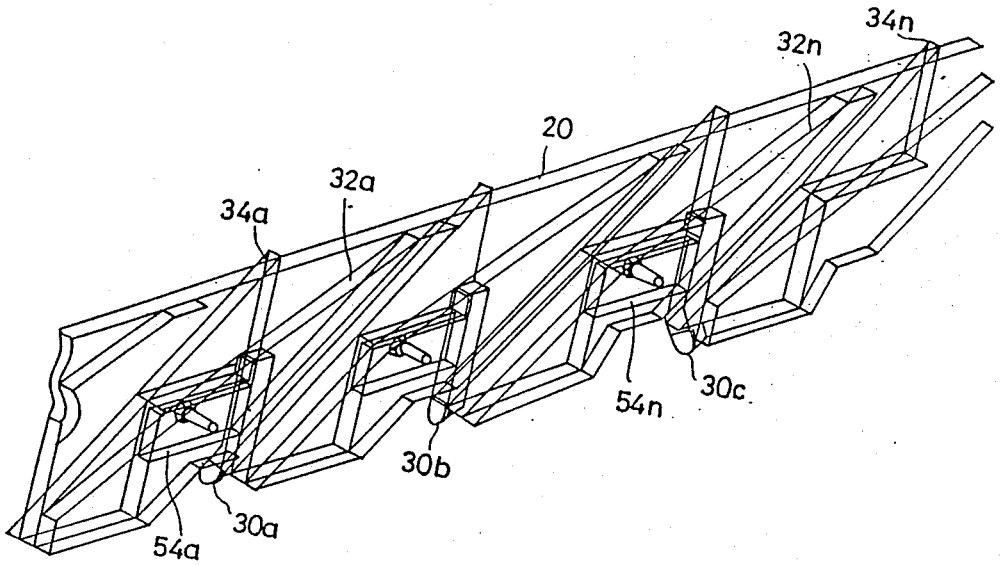
FIG. 8 illustrates an x-ray view of the cutter ring assembly.

FIG. 8 illustrates an x-ray view of the cutter ring assembly 12 as viewed from the exterior of the cutter ring assembly where all numerals correspond to those elements previously described. The ring assembly 12 is illustrated in a plane for purposes of brevity and clarity.

Figure 9:
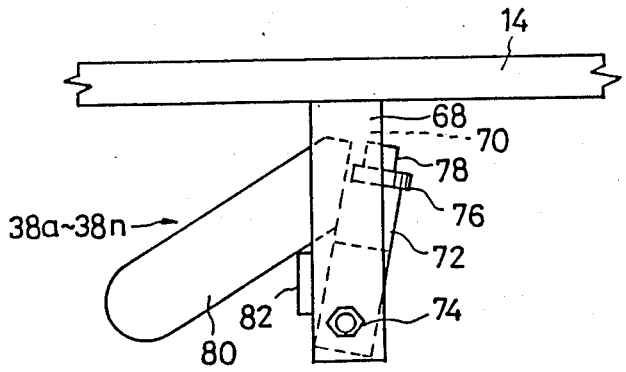
FIG. 9 illustrates a side view of the lever grip assemblies.
Figure 10:
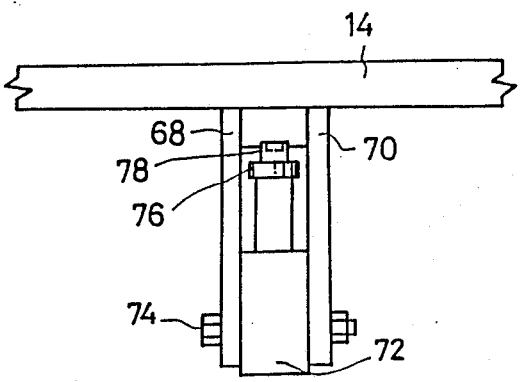
FIG. 10 illustrates an end view of the lever grip assemblies.

FIG. 9 illustrates a side view of the lever grip assemblies 38a–38n where all numerals correspond to those elements previously described. Each of the lever grip assemblies 38a–38n are similar and utilize corresponding numbered parts. A pair of vertical support members 68 and 70 extend vertically and downwardly from the manhole plate 14, as also illustrated in FIG. 10. A configured pivot member 72 pivots about a pivot bolt 74 passing through the lower regions of the vertical support members 68 and 70. The pivot member 72 is a configured rectangular solid having a carbide gripping tooth 76 secured to its upper planar surface by a bolt 78. A lever 80 is welded to the upper portion of the pivot member 72. The weight of the lever 80 is sufficient to keep the pivot member 72 and the associated components positioned as illustrated in this figure. A stop plate 82 prohibits movement of the lever 80 in a downward position. As illustrated later in FIG. 13, the keyway disk 16 engages lever 80 to force the carbide gripping tooth 76 against the inside of the manhole so that it can be lifted upwardly. The entire plurality of lever grip assemblies 38a–38n are activated by the keyway disk 16.

FIG. 10 illustrates an end view of the lever grip assemblies 38a–38n where all numerals correspond to those elements previously described.

MODE OF OPERATION

Figure 11:
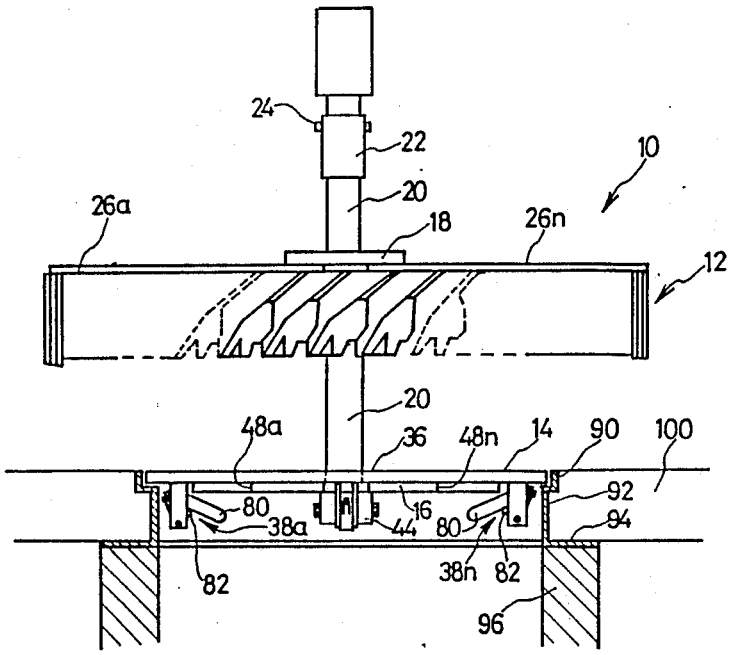
FIG. 11 illustrates the manhole cutter aligned in a manhole.
Figure 12:
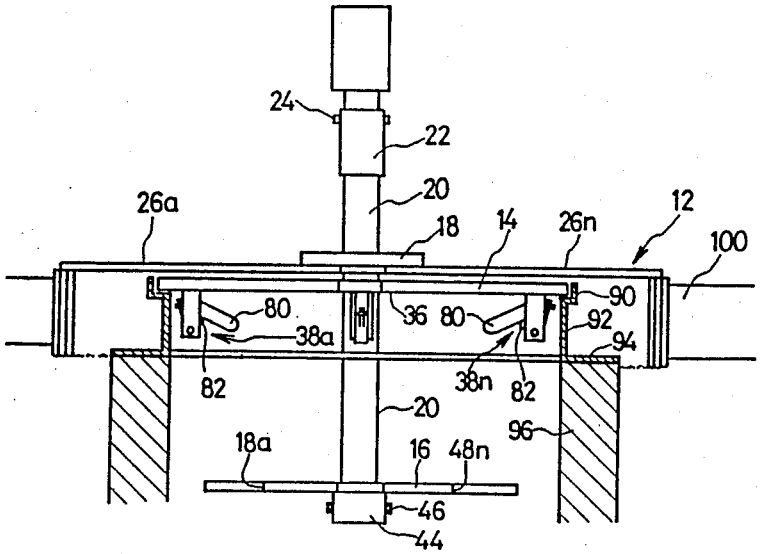
FIG. 12 illustrates a finished cut.
Figure 13:
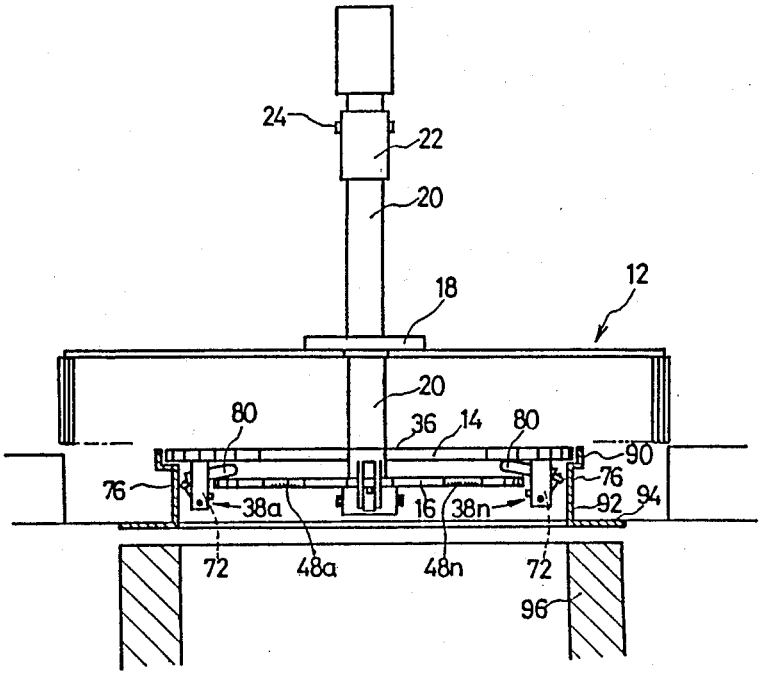
FIG. 13 illustrates the lever grip assemblies engaging the manhole.

FIGS. 11–13 illustrate the mode of operation of the manhole cutter 10.

FIG. 11 illustrates the manhole cutter 10 positioned in an annular cut groove 90 in a manhole 92. The manhole plate 14 aligns in and rests in the annular groove 90. The keyway disk 16 is aligned so that keyways 48a–48n align with the plurality of lever grip assemblies 38a–38n in the keyway disk 16 as illustrated in FIG. 3 to allow passage of the keyway disk 16 below and beyond the lever grip assemblies 38a–38n. At this time, the lever grip assemblies 38a–38n are in the rest or unactivated position. The shaft 20, the cutter ring assembly 12, and the keyway disk 16 are lowered further until the keyway disk 16 is well below the horizontal surface 94 of the manhole 92. At this time, the central drive shaft 20 slides further into the hole 36, allowing the keyway disk 16 to descend below the horizontal surface 94 of the manhole 92 and into the cylindrical concrete structure 96 leading to the underground sewage system. When the keyway disk 16 is lowered into the concrete structure 96 and well clear of the lever grip assemblies 38a–38n, the central drive shaft 20, the cutter ring assembly 12, the keyway disk 16 and associate parts affixed to the shaft 20 are rotated to begin the cutting action of the black top 100. The outer clean-out slots 40a–40n on the outer surface of the cutter ring assembly 12 and the plurality of inner clean-out ramps 34a–34n carry dirt and debris upwardly to the surface to allow for more effective cutting of the black top surface 100.

FIG. 12 illustrates a completed cut about the manhole 92 where the cutter ring assembly 12 has cut a groove even with and in close proximity to the horizontal surface 94 of the manhole 92.

FIG. 13 illustrates the manhole remoVal process. As described in FIG. 3, the keyway disk 16 is rotated so that the keyways 48a–48n are aligned at approximately 45 degrees to the lever grip assemblies 38a–38n. At this time, the central drive shaft 20 is moved upwardly to cause the keyway disk 16 to engage lever 80 and each of the lever grip assemblies 38a–38n causing carbide gripping tooth 76 in each of the lever grip assemblies 38a–38n to engage the inner walls of the manhole as the pivot member 72 is pivoted by action of the keyway disk 16 striking the lever 80 in each of the lever grip assemblies 38a–38n. As the central drive shaft 20 is moved vertically, pressure of the carbide gripping tooth 76 is increased against the inner surface of the manhole 92 so that the manhole can be pulled from the job site and replaced at the job site such as for raising or lowering of the manhole. The replacement operation is a reverse of the above described steps.

Various modifications can be made to the present invention without departing from the apparent scope hereof.

I claim:

1. Apparatus for cutting and removing a manhole comprising:

a. a shaft for securing to a motor;

b. cutter ring assembly on said shaft having a diameter larger than the diameter of said manhole;

c. manhole plate means couplet to said shaft for aligning said cutter ring assembly about said manhole and including lever grip means; and, d. keyway disk means coupled to said shaft for causing engagement of said lever grip means with said manhole for removal of said manhole.

2. Apparatus of claim 1 including staggered teeth coupled to said cutter ring assembly.

3. Apparatus of claim 1 including carbide tipped cutting teeth coupled to said cutter ring assembly.

4. Apparatus of claim 1 wherein said cutter ring assembly further comprises teeth positioned in three different positions, inner, center, and outer positions.

5. Apparatus of claim 1 including inner and outer flutes attached to said cutter ring assembly for carrying debris to the top of said manhole.

6. Method of cutting an annular grove about and removing a manhole casting having a lip for holding a cover plate comprising the steps of:

a. positioning a shaft carrying a cutter ring assembly, a manhole plate having gripping teeth and a plurality of levers, and a keyway disk into a manhole casting;

b. engaging the manhole plate against said lip of said manhole casting;

c. rotating the shaft and the cutter ring assembly secured thereon to cut an annular groove about the manhole casting down to a predetermined depth;

d. aligning the keyway disk to engage said plurality of levers against said gripping teeth; and, e. engaging said gripping teeth against the inner circumference of the manhole casting.

* * * * *